US008314373B1

(12) United States Patent
Watkins

(10) Patent No.: US 8,314,373 B1
(45) Date of Patent: Nov. 20, 2012

(54) MICROWAVE SUSCEPTOR SYSTEM

(76) Inventor: Jeffrey T. Watkins, Princeton, MN (US)

( * ) Notice: Subject to any disclaimer, the term of this patent is extended or adjusted under 35 U.S.C. 154(b) by 297 days.

(21) Appl. No.: 12/616,431

(22) Filed: Nov. 11, 2009

(51) Int. Cl.
*H05B 6/80* (2006.01)

(52) U.S. Cl. ..... 219/730; 219/732

(58) Field of Classification Search ..... 219/759, 219/725, 728, 762, 731, 727, 730, 752, 753, 219/732; 229/104, 107, 117.01, 117.05, 229/113, 115; 426/113, 107, 87, 234, 241
See application file for complete search history.

(56) References Cited

U.S. PATENT DOCUMENTS 5,153,402 A * 10/1992 Quick et al. ..... 219/730
RE34,683 E * 8/1994 Maynard et al. ..... 219/730
2007/0087090 A1* 4/2007 Russell et al. ..... 426/113
* cited by examiner

*Primary Examiner* — Henry Yuen
*Assistant Examiner* — Hung D Nguyen
(74) *Attorney, Agent, or Firm* — Neustel Law Offices

(57) ABSTRACT

A constructable microwave susceptor sheet for holding and cooking a food item in a microwave. The constructable microwave susceptor sheet generally includes an outer panel having a first susceptor layer and a first support layer attached to the first susceptor layer and an inner panel foldably connected to the outer panel for lining an interior surface of the outer panel, wherein the inner panel includes a second susceptor layer and a second support layer attached to the second susceptor layer. The outer panel has a raised platform and a plurality of legs foldably connected to the platform. The outer panel also includes a plurality of retainer flaps vertically extending upward from a perimeter of the platform for retaining a food item thereon. The inner panel seals a plurality of openings extending through the platform which are exposed by the flaps pivoting to a vertical position.

1 Claim, 7 Drawing Sheets

MICROWAVE SUSCEPTOR SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a microwave platform and more specifically it relates to a microwave susceptor system for efficiently cooking food in a microwave.

2. Description of the Related Art

Any discussion of the related art throughout the specification should in no way be considered as an admission that such related art is widely known or forms part of common general knowledge in the field.

Microwave platforms have been in use for years. Typically, microwaveable platforms are utilized by positioning a desired food item (i.e. sandwich, pizza, etc.) on top of the microwaveable platform and then cooking the food item in the microwave. The microwaveable platforms generally have a metallic or other heating material attached to an upper side of the platform which radiates heat toward the food item.

Prior microwave platforms generally have two primary forms. The first is a single layer susceptor tray without elevation features. Not elevating the tray and food item can decrease the performance of the susceptor tray by not allowing the tray to gather a maximum amount of heat to be transferred to the food item. It is commonly used practice to invert the single layer susceptor tray to provide an elevated cooking surface; however this can result in an uneven platform in which to position the food item upon which can further result in grease or juices from the food item dripping off the susceptor tray onto the microwave floor.

Another prior form of a susceptor tray includes a tray with elevating feet that "pop out" when the tray is folded. This type of mechanism allows the food item and susceptor tray to be elevated but creates holes within the susceptor tray bottom thus creating leaking points for the melting ingredients. Because of the inherent problems with the related art, there is a need for a new and improved microwave susceptor system for efficiently cooking food in a microwave.

BRIEF SUMMARY OF THE INVENTION

A system for efficiently cooking food in a microwave. The invention generally relates to a microwave platform which includes an outer panel having a first susceptor layer and a first support layer attached to the first susceptor layer and an inner panel foldably connected to the outer panel for lining an interior surface of the outer panel, wherein the inner panel includes a second susceptor layer and a second support layer attached to the second susceptor layer. The outer panel has a raised platform and a plurality of legs foldably connected to the platform. The outer panel also includes a plurality of retainer flaps vertically extending upward from a perimeter of the platform for retaining a food item thereon. The inner panel seals a plurality of openings extending through the platform which are exposed by the flaps pivoting to a vertical position.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
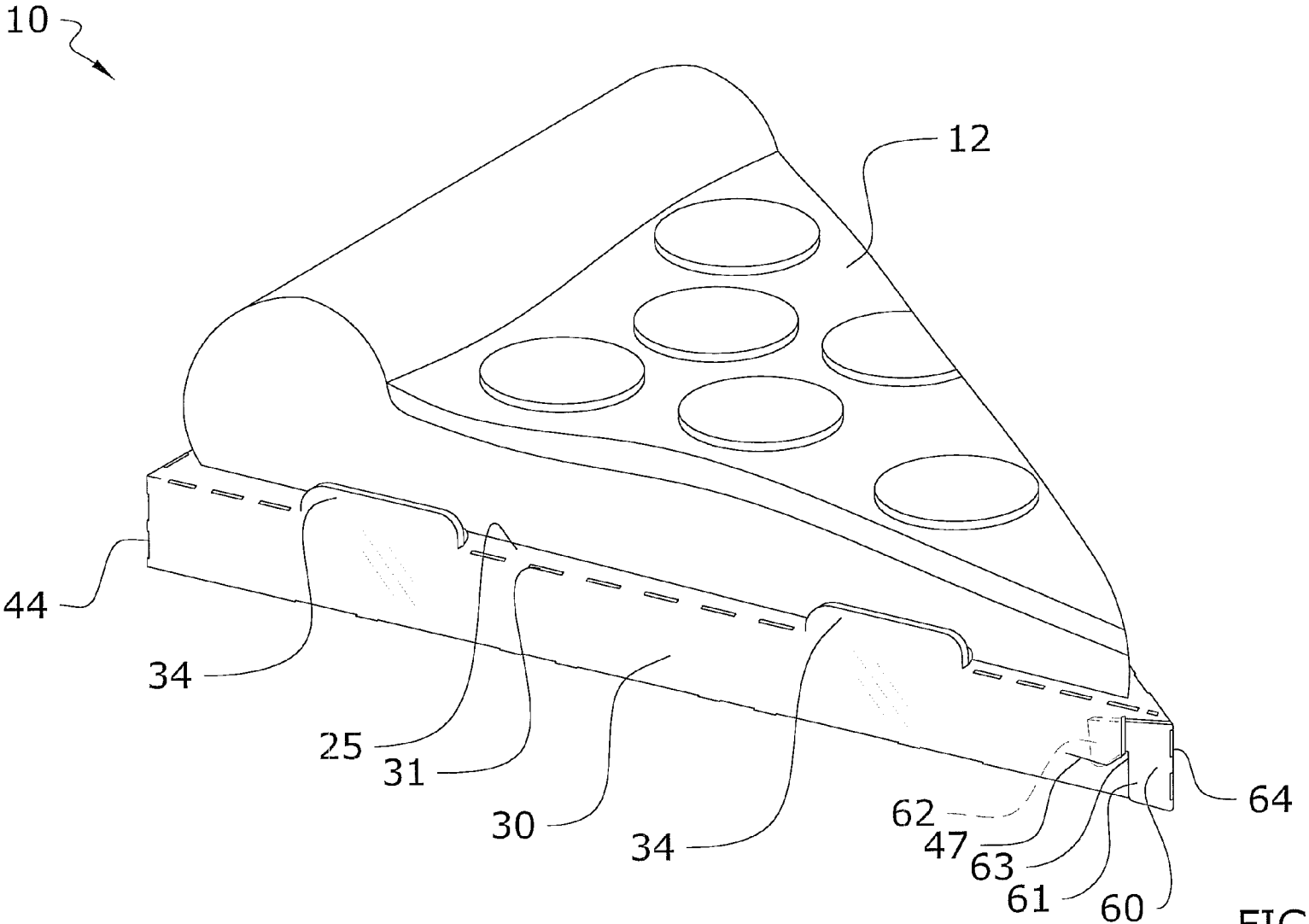
FIG. 1 is an upper perspective view of the present invention with a food item placed thereon.
Figure 2:
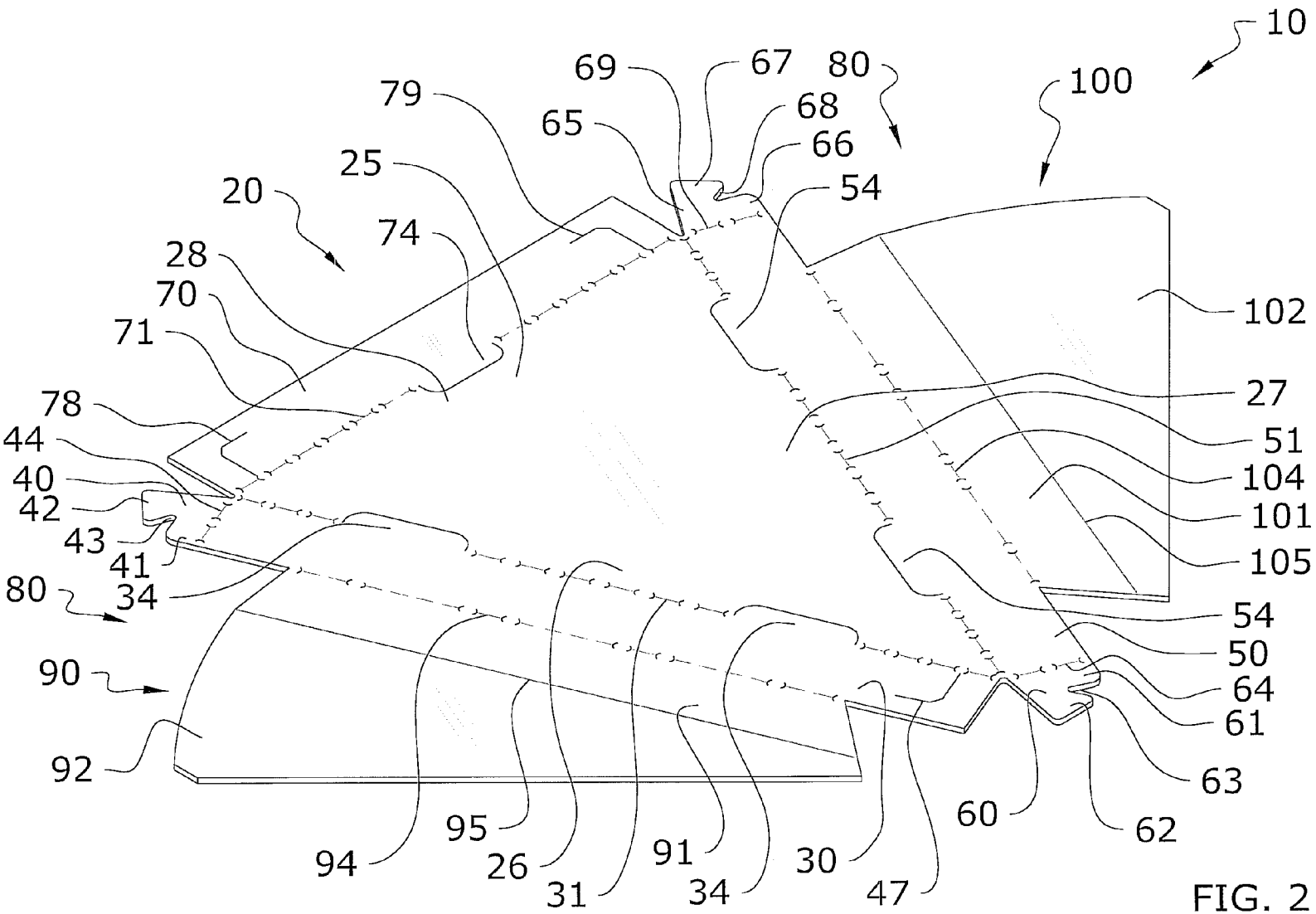
FIG. 2 is an upper perspective view of the present invention in the first position (unfolded).

Turning now descriptively to the drawings, in which similar reference characters denote similar elements throughout the several views, FIGS. 1 through 7 illustrate a microwave susceptor system 10, which comprises an outer panel 20 having a first susceptor layer 21 and a first support layer 22 attached to the first susceptor layer 21 and an inner panel 80 foldably connected to the outer panel 20 for lining an interior surface of the outer panel 20, wherein the inner panel 80 includes a second susceptor layer 81 and a second support layer 82 attached to the second susceptor layer 81. The outer panel 20 has a raised platform 25 and a plurality of legs 30, 40, 50 foldably connected to the platform 25. The outer panel 20 also includes a plurality of retainer flaps 34, 54, 74 vertically extending upward from a perimeter of the platform 25 for retaining a food item 12 thereon. The inner panel 80 seals a plurality of openings 36, 56, 76 extending through the platform 25 which are exposed by the flaps 34, 54, 74 pivoting to a vertical position.

B. Outer Panel

The outer panel 20 generally forms the outermost and visible portion of the present invention when in the folded position. The outer panel 20 is comprised of a foldable sheet configuration with preferably defined fold lines to form a raised platform 25 and a plurality of legs 30, 50, 70 to support the platform 25 in the raised position.

The outer panel 20 also includes a first susceptor layer 21 and a first support layer 22. The first susceptor layer 21 and the first support layer 22 are attached to each other along an entire facing surface area between the two layers 21, 22. The first susceptor layer 21 preferably comprises the outside or exterior surface of the outer panel 20 and is used to collect energy from the microwave and transfer that energy to the food item 12 placed thereupon. The first support layer 22 comprises the inside or interior surface of the outer panel 22 and is used to both absorb moisture or liquid released from the food item 12 and to provide support to the first susceptor layer 21. The first susceptor layer 21 is generally comprised of a much thinner and less rigid structure than the first support layer 22. The first susceptor layer 21 and the first support layer 22 preferably extend throughout the platform 25, the legs 30, 50, 70, retainer flaps 34, 54, 74, and any other portion of the outer panel 20 as described herein. It is appreciated that the first susceptor layer 21 may extend over only the platform 25 or various other areas of the outer panel 20 rather than the entire exterior surface. The first support layer 22 and the second support layer 82 may be comprised of various materials, such as but not limited to paperboard.

The outer panel 20 may also include a demetallizing pattern 23 upon the exterior surface of the susceptor layer 21 in areas that the heat collection is desired to be less in order to prevent burning or over cooking of the food item. In the preferred embodiment, the demetallizing pattern 23 is illustrated along the perimeter of the platform 25 of the outer panel 20, wherein the food item 12 may not need as much cooking in this area. It is appreciated that the smaller the squares or lesser metallic area of the exterior surface, the less heat will be collected and produced. The squares, as illustrated, include the metallic material deemed susceptor material, and the surrounding grid around the squares does not. In the alternate embodiment, the squares may be smaller and grid more pronounced and thus a greater amount of area is demetalized and a lesser amount of heat is collected and transferred to the food item 12. It is appreciated that various other patterns of the demetallizing pattern 23 may be used.

The platform 25 is for positioning the food item 12 upon and is generally comprised of a raised structure which allows for the food item 12 to be more evenly and thoroughly heated and cooked. The platform 25 is also generally planar in structure and positioned parallel with the floor of the microwave. In the preferred embodiment the platform 25 is comprised of a triangular shape, such as to resemble a pizza slice for positioning a pizza slice thereon. It is appreciated that the platform 25 may resemble various other food items 12 and be comprised of various other shapes rather than the preferred embodiment.

A plurality of legs 30, 50, 70 extend from each side 25, 26, 27 of the platform 25 to form a first leg 30, a second leg 50, and a third leg 70. The legs 30, 50, 70 are foldably connected to the platform 25 along a plurality of fold lines 31, 51, 71. In the preferred embodiment, the fold lines 31, 51, 71 are comprised of perforations. Each leg 30, 50, 70 also preferably extends along an entire length as a respective side 25, 26, 27 of the platform 25 to form an elongated structure of the legs 30, 50, 70. The legs 30, 50, 70 are further comprised of a substantially rectangular shape to evenly support the platform 25 above and parallel to the floor of the microwave.

Each leg 30, 50, 70 includes one or more retainer flaps 34, 54, 74 extending towards and within the platform 25. The retainer flaps 34, 54, 74 are preferably connected to the respective legs 30, 50, 70 to fold with the legs 30, 50, 70 as the legs 30, 50, 70 fold away from the platform 25. When in a non folded first position, the retainer flaps 34, 54, 74 and legs 30, 50, 70 are parallel with the platform 25. When in a folded second position, the retainer flaps 34, 54, 74 are legs 30, 50, 70 are perpendicular with the platform 25. The top of the legs 30, 50, 70, in the second position, is at a similar height as the platform 25, yet the top of the retainer flaps 34, 54, 74 extend above the platform 25 for retaining the food item 12 by preventing the food item 12 from sliding off of the platform 25 when positioning within or removing the present invention and food item 12 from the microwave.

The retainer flaps 34, 54, 74 may be removably connected, such as through the use of perforations, or simply loosely positioned within defined openings 36, 56, 76 of the platform 25 in the first position. When folding to the second position, the retainer flaps 34, 54, 74 form or expose the openings 36, 56, 76. The openings 36, 56, 76 may also serve as partial vents for the food item 12; however it is appreciated that the lower end of the openings 36, 56, 76 is sealed via the inner panel 80.

At least some of the legs 30, 50, 70 include connectors 40, 60, 65 and at least some of the legs 30, 50, 70 include corresponding slots 47, 78, 79 for receiving the connectors 40, 60, 65. The connectors 40, 60, 65 are insertable within the slots 47, 78, 79 to attach adjacent legs 30, 50, 70 to each other in an upright and folded position (i.e. second position as previously described). The connectors 40, 60, 65 and slot areas are preferably integral with the legs 30, 50, 70 and thus each include the first susceptor layer 21 and the first support layer 22 of the outer panel 20.

Each connector 40, 60, 65 includes a first portion 41, 61, 66 for overlapping the exterior surface of the adjacent leg 30, 50, 70 and a second portion 42, 62, 67 insertable within an adjacent slot 47, 78, 79 and separated from the first portion 41, 61, 66 via a notch 43, 63, 68. The second portion 42, 62, 67 extends from the first portion 41, 61, 66 and is positioned along the interior surface of the adjacent leg 30, 50, 70. The first portion 41, 61, 66 extends from a lower part of the leg 30, 50, 70 and the second portion 42, 62, 67 extends from an upper part of the leg 30, 50, 70 and angles downwardly so as to extend through the slot 47, 78, 79 and below the slot 47, 78, 79 to be retained by the leg 30, 50, 70.

Each slot 47, 78, 79 is preferably positioned slightly inwardly from the end of the respective leg 30, 50, 70 to leave space for the first portion 41, 61, 66 of the connector 40, 60, 65 to overlap the adjacent leg 30, 50, 70 without overlapping the slot 47, 78, 79. The slot 47, 78, 79 further forms an L-shape to allow the second portion 42, 62, 67 to be easily inserted through the slot 47, 78, 79 to connect adjacent legs 30, 50, 70.

Each connector 40, 60, 65 is also preferably pivotally connected to the respective leg 30, 50, 70 to bend around a respective corner and attach to the adjacent leg 30, 50, 70. A fold line 44, 64, 69 extends vertically across the leg 30, 50, 70 in a perpendicular manner, wherein the fold line 44, 64, 69 is preferably comprised of a perforation to allow for accurate and easy bending of the connector 40, 60, 65 with respect to the leg 30, 50, 70.

In the preferred embodiment, the first leg 30 includes a first connector 40 extending form a rear end of the first connector 40 and a first slot 47 extending from a front end. The first connector 40 is insertable through a second slot 78 of the third leg 70. The first slot 47 is received by a second connector 60 of the second leg 50. Likewise, a third connector 65 extending from the second leg 50 opposite the second connector 60 is insertable through a third slot 79 of the third leg 70, wherein the third slot 79 is opposite the second slot 78. It is appreciated that the connectors 40, 60, 65 and slots 47, 78, 79 may be arranged on the legs 30, 50, 70 in various alternate manners or arrangements. It is also appreciated that various other fastening mechanisms may be used to secure the legs 30, 50, 70 together.

C. Inner Panel

The inner panel 80 generally forms the innermost and non visible portion of the present invention when in the folded position. When in the unfolded position, the inner panel 80 actually extends from the outer panel 20. The inner panel 80 is comprised of a foldable sheet configuration with preferably defined fold lines to be folded to substantially match the interior shape of the outer panel 20 when in the raised or first position. The entire outer panel 20 and inner panel 80, in the first position, are comprised of a sheet structure having a plurality of fold lines. To construct the present invention in the second position, the sheet is simply folded along the fold lines.

The inner panel 80 also includes a second susceptor layer 81 and a second support layer 82. The second susceptor layer 81 and the second support layer 82 are attached to each other along an entire facing surface area between the two layers. The second susceptor layer 81 preferably faces inwardly towards the floor of the microwave and is used to collect energy from the microwave and transfer that energy to the food item 12 placed upon the platform 25 of the outer panel 20. The second support layer 82 comprises is positioned around an outside of the second susceptor layer 81 and is directly positioned against the first support layer 22 thus separating the two susceptor layers 21, 81 by the two support layers 22, 82.

The second support layer 82 is used to both absorb moisture or liquid released from the food item 12 and to provide support to the second susceptor layer 81. The second susceptor layer 81 and the support layer preferably extend throughout the wings 90, 100 of the inner panel 80 as described herein. It is appreciated that the first susceptor layer 21 upon the outer surface of the outer panel 20 which faces upwards and the second susceptor layer 81 upon the outer surface of the inner panel 80 which faces downwards may include a demetallizing pattern around the perimeter edges in areas that do not need to collect heat to transfer that heat to the food item 12 in areas where heat transfer is not desired or needed. The second susceptor layer 81 is generally comprised of a much thinner and less rigid structure than the second support layer 82. It is appreciated that the second susceptor layer 81 may extend over only the bottom portions 92, 102 or various other areas of the inner panel 80 rather than the entire exterior surface.

The inner panel 80 may also include a demetallizing pattern 85 upon the exterior surface of the susceptor layer 81 in areas that the heat collection is desired to be less in order to prevent burning or over cooking of the food item. In the preferred embodiment, the demetallizing pattern 85 is illustrated along the perimeter of the bottom portion 92, 102 of the inner panel 80, wherein the food item 12 may not need as much cooking in this area. It is appreciated that the smaller the squares or lesser metallic area of the exterior surface, the less heat will be collected and produced. The squares, as illustrated, include the metallic material deemed susceptor material, and the surrounding grid around the squares does not. In the alternate embodiment, the squares may be smaller and grid more pronounced and thus a greater amount of area is demetalized and a lesser amount of heat is collected and transferred to the food item 12. It is appreciated that various other patterns of the demetallizing pattern 85 may be used.

The inner panel 80 is foldably connected to the outer panel 20 via a plurality of fold lines 94, 104 that are preferably comprised of perforations. The inner panel 80 is further preferably comprised of a first wing 90 and a second wing 100, wherein the first wing 90 is foldably connected to the first leg 30 of the outer panel 20 and the second wing 100 is foldably connected to the second leg 50 of the outer panel 20.

Each wing 90, 100 includes an inner leg portion 91, 101 and a bottom portion 92, 102. When the wings 90, 100 are folded to the second position of the present invention, the inner leg portion 91, 101 extends along the interior of the respective leg 30, 50 of the outer panel 20 and the bottom portion 92, 102 extends along the interior or bottom of the platform 25 of the outer panel 20 along a respective side 26, 27 of the platform 25. Each wing 90, 100 serves multiple purposes, such as providing support to the outer panel 20, increasing the exposed surface area of the susceptor material and preventing moisture or other liquids (e.g. grease) from the food item 12 from leaking through the openings 36, 56, 76 of the outer panel 20 onto the microwave floor.

The second susceptor layer 81 that extends from the inner leg portion 91, 101 across to the bottom portion 92, 102 is preferably not perforated, scored, or cut in any manner to provide a watertight barrier that prevents liquids from dripping through. The second support layer 82 is preferably scored at the folding line 95, 105 between the inner leg portion 91, 101 and the bottom portion 92, 102 only through the second support layer 82 to allow for easy bending of the wing 90, 100, but not through the second susceptor layer 81 to prevent liquid leakage therethrough.

The front end of each of the wings 90, 100 and the connected leg 30, 50, 70 define an acute angle. The front end of the wings 90, 100 is angled in such a manner so that when folded underneath the outer panel 20, each wing 90, 100 extends at a perpendicular angle with respect to a longitudinal axis of the outer panel 20. Each bottom portion 92, 102 of each of the wings 90, 100 also preferably extends half way across the bottom of the platform 25 and thus meet in the middle.

D. Assembly of Preferred Embodiment

Figure 3:
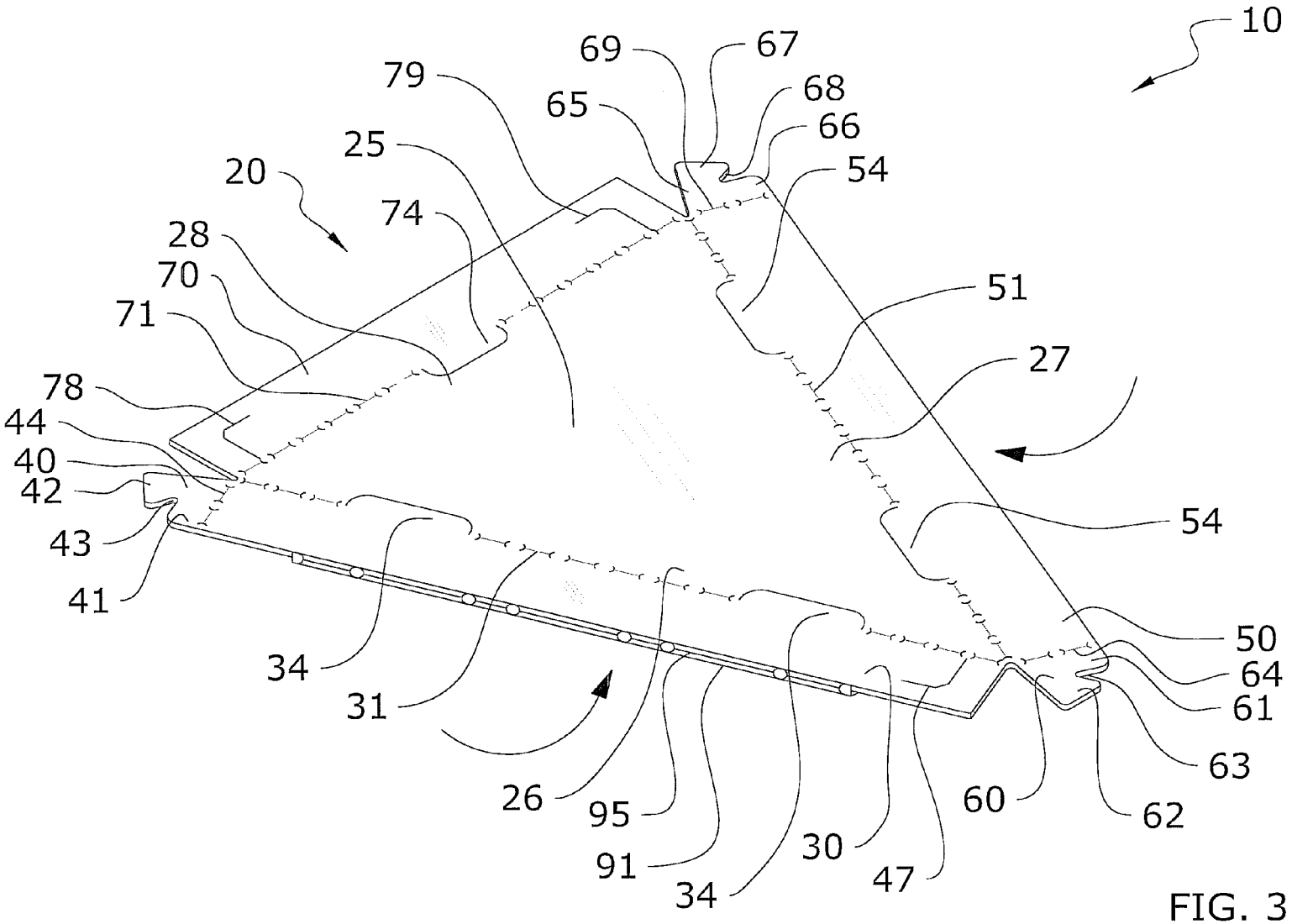
FIG. 3 is an upper perspective view of the present invention with the inner panel folded underneath the outer panel.
Figure 4:
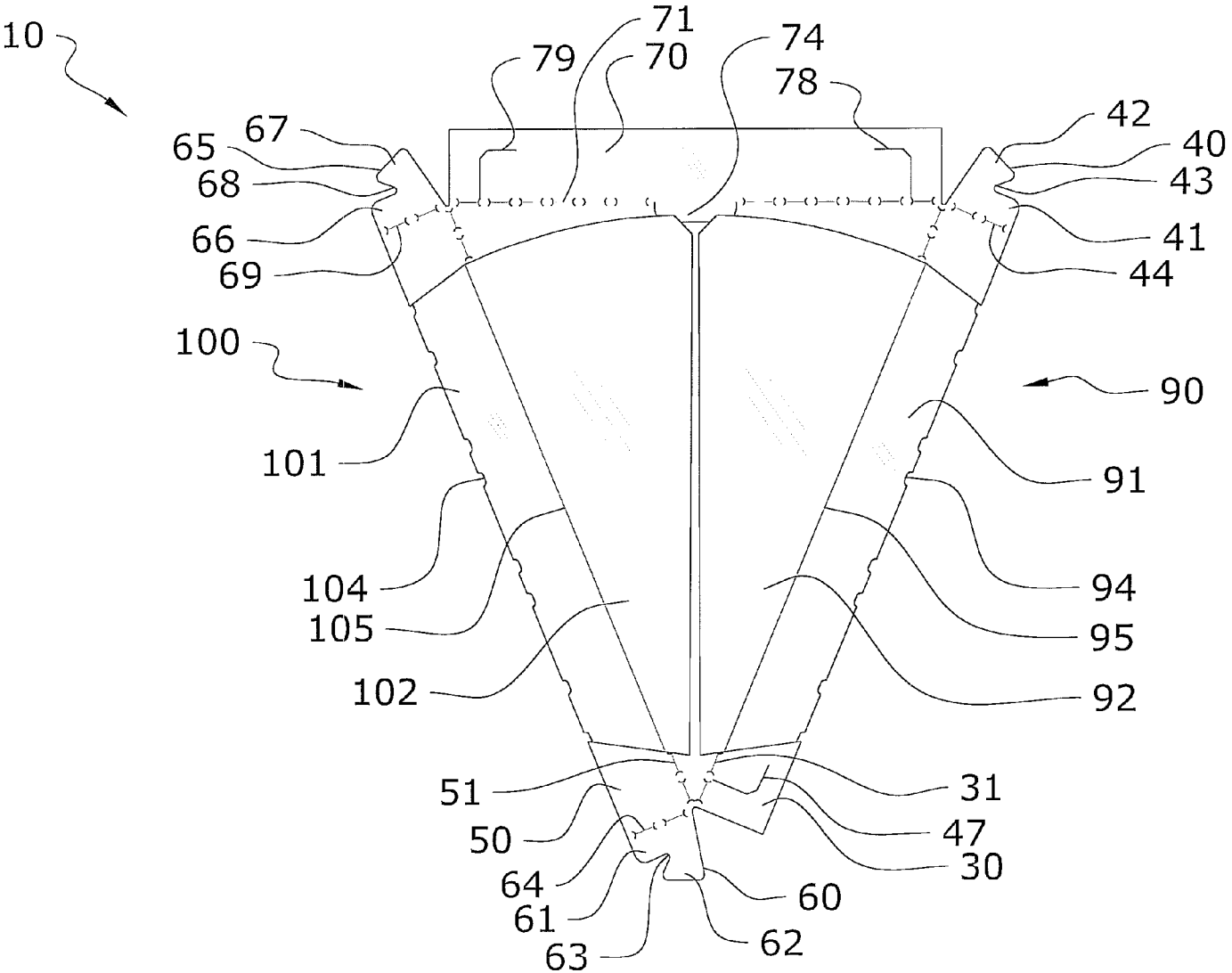
FIG. 4 is a bottom view of the present invention with the inner panel folded underneath the outer panel.

During assembly, the wings 90, 100 of the inner panel 80 are first folded towards each other underneath the outer panel 20 as illustrated in FIGS. 3 and 4. The first inner leg portion 91 is adhered to the interior surface of the first leg 30 via an adhesive 83 and the second inner leg portion 101 is adhered to the interior surface of the second leg 50 via an adhesive 83. The first bottom portion 92 and the second bottom portion 102 are folded parallel with the platform 25 and allowed to remain loose with respect to the bottom of the platform 25 to be able to slide or move towards and away from each other while constructing the present invention and folding the legs 30, 50, 70.

Figure 5:
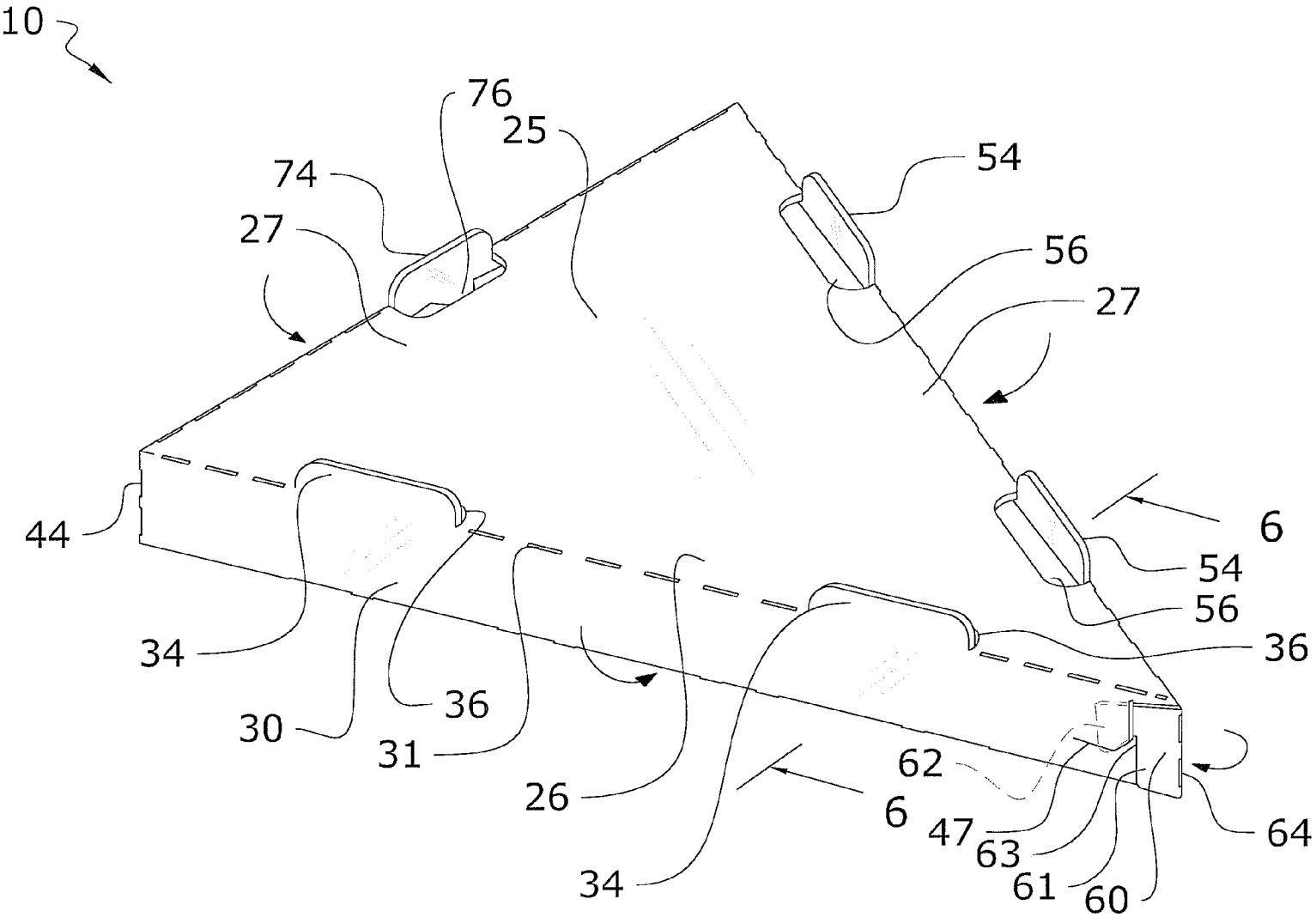
FIG. 5 is an upper perspective view of the present invention in the second position (folded).
Figure 6:
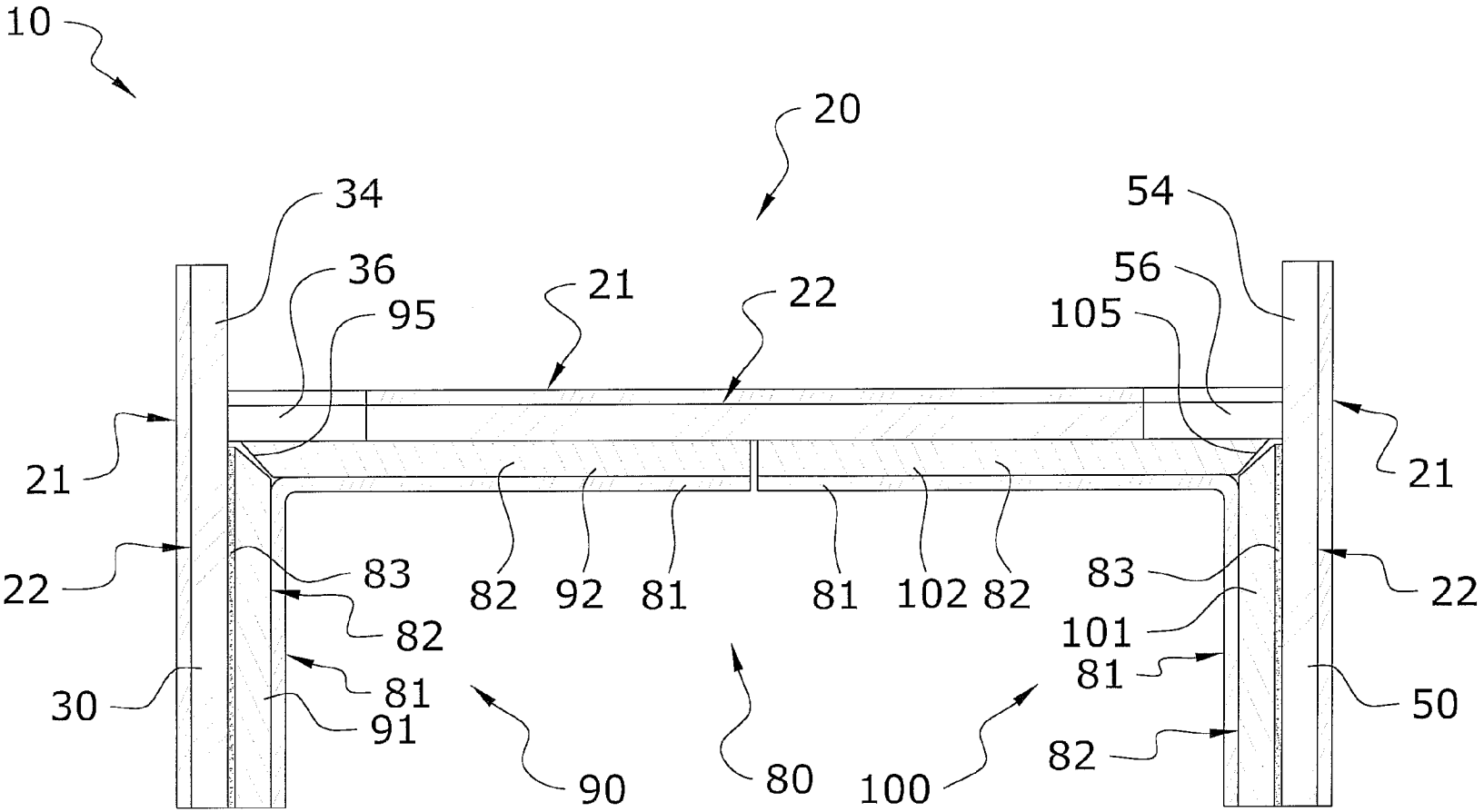
FIG. 6 is a sectional view taken along lines 6-6 of FIG. 5.
Figure 7:
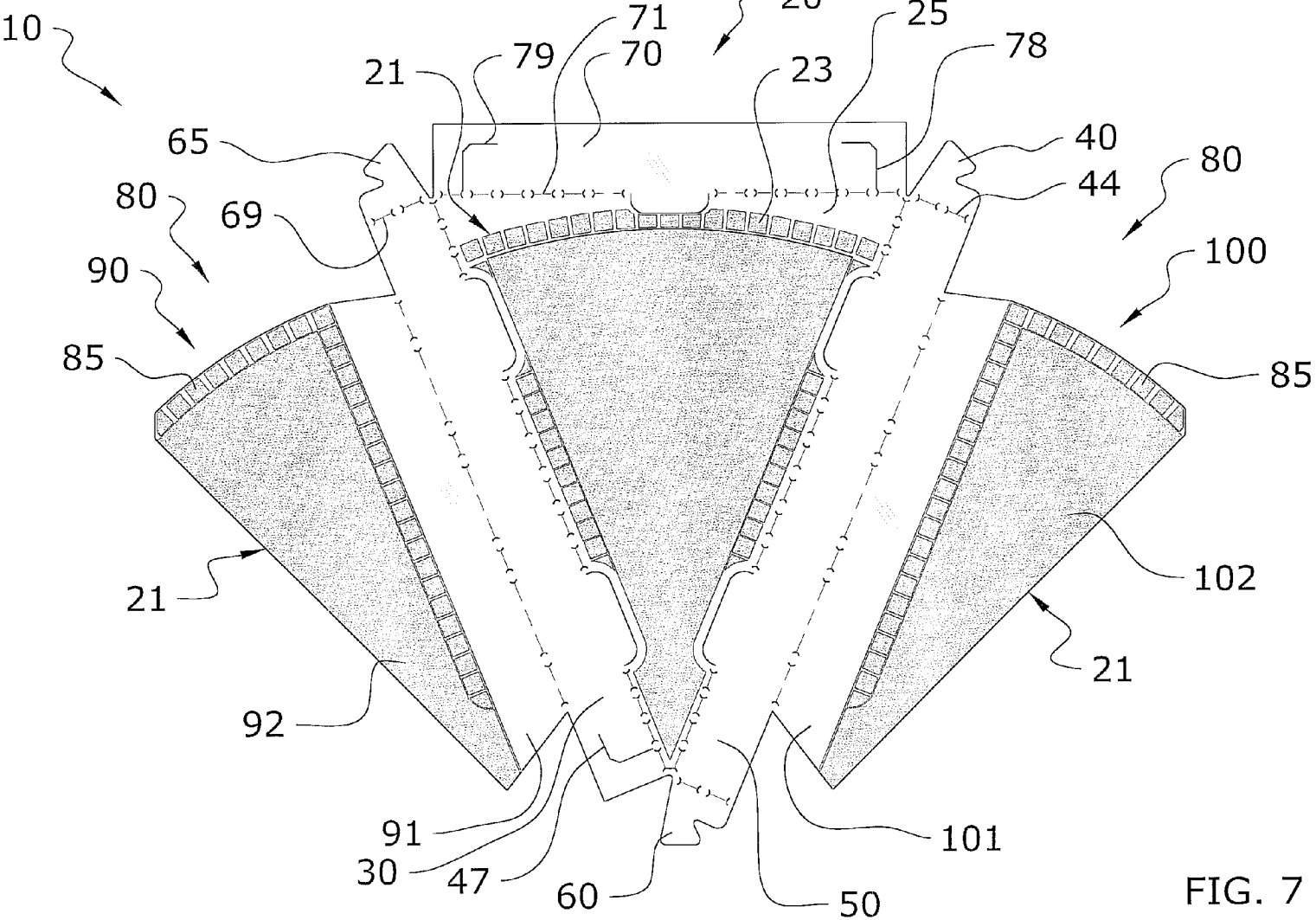
FIG. 7 is a top view of the present invention in the first position (unfolded) illustrating the demetallizing pattern.

The legs 30, 50, 70 are now folded to be perpendicular with the platform 25 and extend downwards thus elevating the platform 25 as illustrated in FIG. 5. When the legs 30, 50, 70 are folded downwards the retainer flaps 34, 54, 74 fold with the legs 30, 50, 70 away from the platform 25 to extend vertically above the platform 25 from a perimeter edge of the platform 25. When folded upwards, openings 36, 56, 76 that the retainer flaps 34, 54, 74 were previously nesting within are left exposed to the upper external environment. The retainer flaps 34, 54, 74 extend sufficiently above the platform 25 from a perimeter of the platform 25 to retain the food item 12 upon the platform 25.

Each connector 40, 60, 65 is then folded along the fold line 44, 64, 69 around the adjacent corner to position the first portion 41, 61, 66 along an exterior of the adjacent leg 30, 70 and the second portion 42, 62, 67 through the slot 47, 78, 79 of the adjacent leg 30, 70 and thus removably secure the adjacent legs 30, 50, 70 together. This step is repeated along each of the corners of the platform 25 to secure the legs 30, 50, 70 together in an upright manner. In addition to the connectors 40, 60, 65 and the slots 47, 78, 79 securing the legs 30, 50, 70 together, the connectors 40, 60, 65 and slots 47, 78, 79 also prevent the legs 30, 50, 70 from folding back to the first position by retaining the legs 30, 50, 70 in the second position.

E. Operation of Preferred Embodiment

In use, the present invention may be constructed in a reusable structure or disposable structure. The food item 12 is centered upon the platform 25 and the assembled present invention is positioned within the microwave. The food item 12 is generally placed upon the first susceptor layer 21 of the outer panel 20, wherein the first susceptor layer 21 generally forms the external layer of the outer panel 20. The retainer flaps 34, 54, 74 around the perimeter of the platform 25 assist in retaining the food item 12 upon the platform 25 when transferring to or from the microwave.

The microwave is then turned on, thus heating and crisping the food item 12. The food item 12 may be turned over halfway through the cooking process if desired. The susceptor layers 21, 81 each collect heat while the microwave is on and transfer the collected heat to the food item 12 to heat the food item 12 thoroughly. The support layers 22, 82, along with providing support to the susceptor layers 21, 81, absorb moisture and liquids from the food item 12. Liquids dripping through the openings 36, 56, 76 of the platform 25 are partially absorbed within the first support layer 22 and partially absorbed within the second support layer 82. The second susceptor layer 81 prevents the liquids from dripping through onto the microwave floor. When cooking is complete the food item 12 is removed from the platform 25 and the present invention is either washed and stored for later us or discarded.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A microwave susceptor structure for cooking a food item in a microwave, comprising:

an outer panel having a platform and a plurality of legs, wherein said plurality of legs are foldably connected to said platform;

wherein said platform is comprised of a triangular shape;

wherein said plurality of legs include a first leg extending along a first side of said platform, a second leg extending along a second side of said platform, and a third leg extending along a third side of said platform;

wherein said plurality of legs include a plurality of connectors for connecting said plurality of legs to each other;

wherein said plurality of connectors are foldably connected to said plurality of legs;

wherein said plurality of connectors each include a first portion and a second portion, wherein said first portion is partially separate from said second portion via a notch;

wherein said first portion is positioned along an exterior surface of an adjacent leg of said plurality of legs and wherein said second portion is insertable through a slot of said adjacent leg to be positioned an interior surface of said adjacent leg;

wherein said outer panel includes a plurality of flaps vertically extending from a perimeter of said platform;

wherein said plurality of flaps are connected to said plurality of legs;

wherein said plurality of flaps are planar with said platform in a first position and wherein said plurality of flaps are perpendicular with said platform in a second position;

wherein said plurality of flaps extend above said platform in said second position;

wherein said platform includes a plurality of openings along said perimeter of said platform;

wherein said plurality of openings are adjacent said plurality of flaps;

wherein said outer panel includes a first susceptor layer and a first support layer, wherein said first susceptor layer is attached to said first support layer; and an inner panel for lining an interior surface of said outer panel, wherein said inner panel covers most of said interior surface of said outer panel, wherein said inner panel is foldably connected to said outer panel;

wherein said inner panel includes a second susceptor layer and a second support layer, wherein said second susceptor layer is attached to said second support layer;

wherein said inner panel includes a first wing and a second wing;

wherein said first wing is foldably connected to a first leg of said plurality of legs and wherein said second wing is foldably connected to a second leg of said plurality of legs;

wherein said first wing and said second wing each include an inner leg portion and a bottom portion, wherein said inner leg portion is foldably connected to said bottom portion;

wherein at least a portion of said inner panel is fixedly secured to at least a portion of said interior surface of said outer panel;

wherein said inner panel seals a lower end of said plurality of openings;

wherein said second support layer is positioned directly adjacent said first support layer to separate said first susceptor layer and said second susceptor layer;

wherein said outer panel includes a first demetallizing pattern along said first susceptor layer upon said platform;

wherein said first demetallizing pattern is comprised of a grid shape;

wherein said inner panel includes a second demetallizing pattern along said second susceptor layer of said first wing and said second wing;

wherein said second demetallizing pattern is comprised of a grid shape;

wherein said bottom portion of said first wing and said second wing are adjacent to said outer panel;

wherein said first wing and said second wing meet in a middle of said outer panel.

* * * * *